US005147990A

United States Patent [19]

Dionisio, Jr. et al.

[11] Patent Number: 5,147,990

[45] Date of Patent: Sep. 15, 1992

[54] INTEGRAL SLIDE SWITCH

[75] Inventors: Vito Dionisio, Jr., Sunrise; William M. Bradford, Davie; David H. Karl, Tamarac; Peter B. Gilmore, Plantation, all of Fla.

[73] Assignee: Motorola, Inc., Schaumburg, Ill.

[21] Appl. No.: 677,911

[22] Filed: Apr. 1, 1991

[51] Int. Cl.[5] ..... H01H 15/00

[52] U.S. Cl. ..... 200/16 R; 200/517; 200/548

[58] Field of Search ..... 210/5 R, 5 A, 11 R, 210/16 R, 512-517, 547, 548-551, 6 R, 6 A, 511, 61.85

[56] References Cited

U.S. PATENT DOCUMENTS

| | | | |
|---|---|---|---|
| 3,745,288 | 7/1973 | Reimer | 200/16 A |
| 3,860,771 | 1/1975 | Lynn et al. | 200/5 A |
| 3,983,355 | 9/1976 | Hyodo | 200/16 R X |
| 4,051,337 | 9/1977 | Warrin | 200/61.85 |
| 4,180,711 | 12/1979 | Hirata et al. | 200/5 A |
| 4,207,443 | 6/1980 | Matsuura | 200/5 A |
| 4,322,588 | 3/1982 | Chumley et al. | 200/5 A |
| 4,851,625 | 7/1989 | Liebich | 200/511 |
| 4,918,264 | 4/1990 | Yamamoto et al. | 200/5 R |

*Primary Examiner*—J. R. Scott
*Attorney, Agent, or Firm*—Pablo Meles

[57] ABSTRACT

A slide switch (10) comprises a housing (12) having at least one cantilever beam (22 and 23) integrally formed in the housing (12). A keypad (24 and 25) is arranged and constructed below at least one of the cantilever beams (22 and 23). A horizontal slide actuator (30) is arranged and constructed to slide over the cantilever beam (22 and 23) for substantially biasing the cantilever beam (22 and 23) toward the keypad (24 and 25).

16 Claims, 4 Drawing Sheets

INTEGRAL SLIDE SWITCH

TECHNICAL FIELD

This invention relates generally to switches, and more specifically to an integrally formed switch within a housing.

BACKGROUND

Membrane switches are commonly used in calculators and portable communication products. These products are typically low profile and rarely utilize slide switches except for turning on and off the product. Slide switches usually fail to provide a seal from the outside environment. Furthermore, slide switches on portable products rarely provide multifunctional capability. Thus, a need exists for a slide switch that could be utilized in a low profile shaped portable product, and yet still provides a seal to the outside environment.

Keypads are typically only axially actuated. When a keypad is used as a function key, the function maybe indicated by a display. Accounting for the function or functions activated by keypad depressions would be difficult without a visual display. A slide switch, on the other hand, provides a visual display of the function being used (i.e., on or off) by the location slide switch. Thus, a low profile slide switch for activating keypads would be desirable.

SUMMARY OF THE INVENTION

Briefly, according to the invention, a slide switch comprises a housing having at least one cantilever beam integrally formed in the housing. A keypad is arranged and constructed below at least one of the cantilever beams. A horizontal slide actuator is arranged and constructed to slide over the cantilever beam for substantially biasing the cantilever beam toward the keypad.

DETAILED DESCRIPTION OF THE PREFERRED EMBODIMENT

Figure 1:
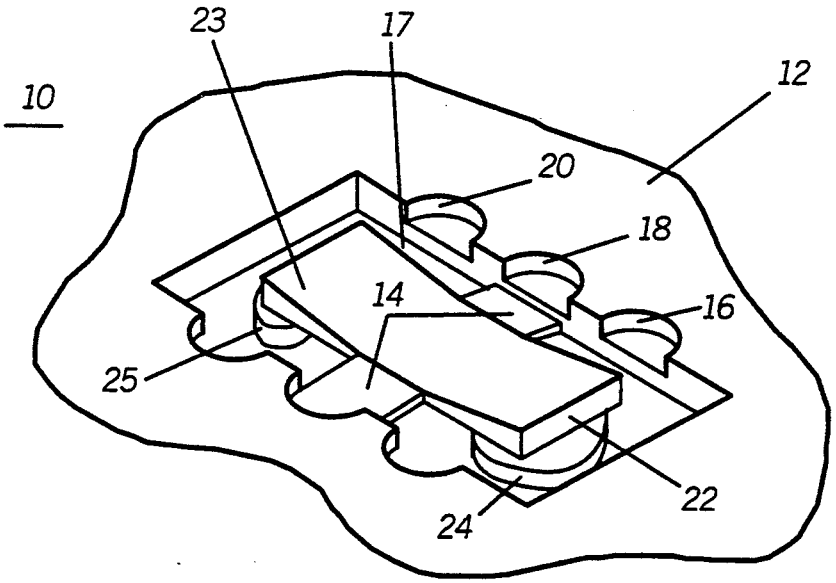
FIG. 1 is a perspective view of a slide switch in accordance with the present invention.

Referring to FIG. 1, there is shown a slide switch 10 having a housing 12 with a torsion bar 14 and two cantilever beam actuators 22 and 23 formed therein, and a keypad 24 and 25 lying below housing 12. The housing 12 is preferably made from a resilient plastic allowing for the flexible movement of the torsion bar 14 and the cantilever beam actuators 22 and 23. The torsion bar 14 and cantilever beam actuators 22 and 23 are formed within an opening 17 within housing 12. The cantilever beam actuators 22 and 23 are integrally appendaged to the torsion bar 14, forming a cross shape within the opening 17. Additionally, detents 16, 18, and 20 are preferably formed at opposing walls within the opening 17 of the housing 12.

Figure 2:
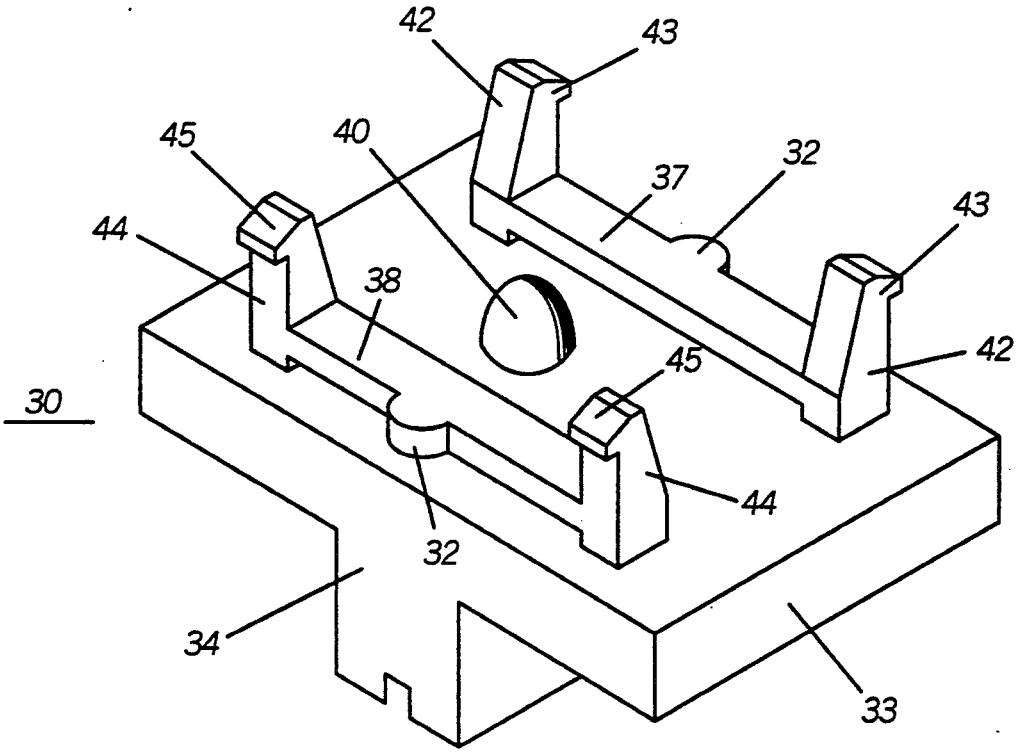
FIG. 2 is a bottom side perspective view of a slide actuator in accordance with the present invention.

Referring to FIG. 2, there is shown a bottom side perspective view of a slide switch actuator 30 having a horizontal member 33. The slide actuator 30 preferably has detent protrusions 32 matching the detent indentations 16, 18, and 20 of housing 12 in FIG. 1. The slide actuator 30 preferably includes a pedestal 34 to allow a user to easily move the slide actuator 30 horizontally. The actuator further includes members 37 and 38 having leg members 42 and 44 respectively. The leg members 42 and 44 have opposing latch features 43 and 45 respectively that allows the slide actuator 30 to couple to the underside of the housing 12, but yet allow the slide actuator 30 to slide horizontally within the opening 17 of the housing 12. Finally, the slide actuator preferably comprises a protruding member 40 that biases the cantilever beam actuators 22 and 23 toward their respective keypads when selected. The protruding member 40, as shown, is dome shaped, but other shapes that could slide above and bias the cantilever beams would be within contemplation of the present invention.

Figure 3:
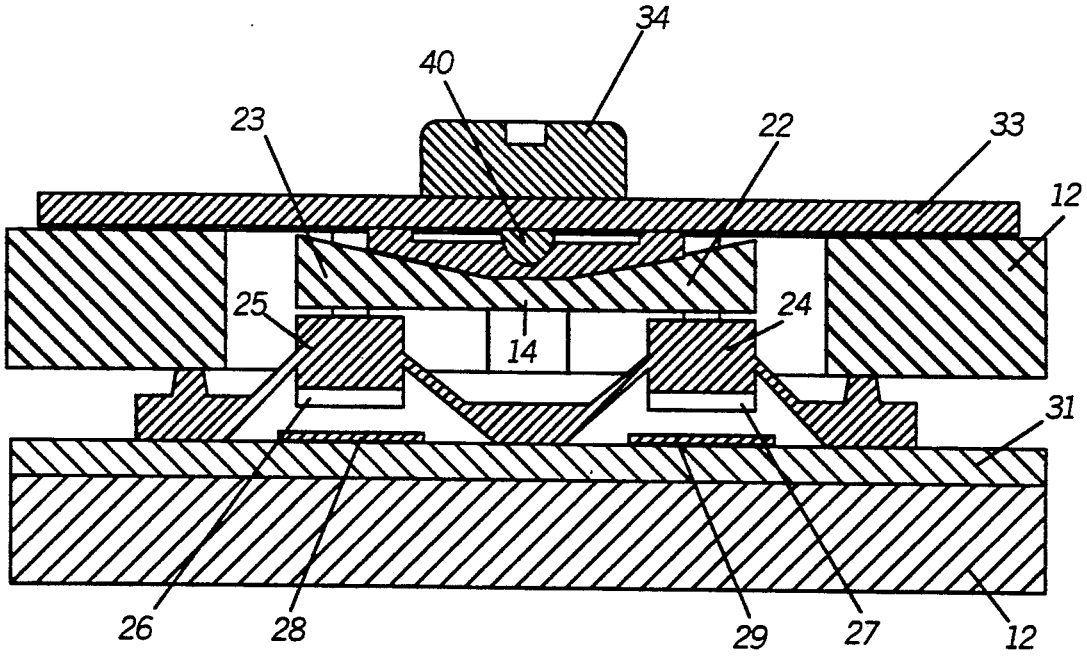
FIG. 3 is a cross-sectional view of the slide switch and actuator of FIGS. 1 and 2.

Referring to FIG. 3, there is shown a cross sectional view of the slide switch 10 and the actuator 30 as assembled. The keypads 24 and 25 preferably lie above the cantilever beams 22 and 23 respectively. The keypads 24 and 25 preferably have conductive pads 27 and 26 respectively that couple to conductive traces 29 and 28 respectively. The conductive traces 28 and 29 are preferably formed on a substrate 31. As shown, the slide actuator comprised of a pedestal 34 coupled to a horizontal member 33 and having a protruding member 40 mounted below horizontal member 33 is centrally disposed above the torsion bar 14. Operationally, as the slide actuator is moved to the right, the cantilever beam 22 is biased by the protruding member 40 towards the keypad 24, causing the conductive pad 27 to electronically couple to the conductive trace 29. Likewise, as the slide actuator is moved to the left, the cantilever beam 23 is biased by the protruding member 40 towards the keypad 25, causing the conductive pad 26 to electronically couple to the conductive trace 28.

Figure 4:
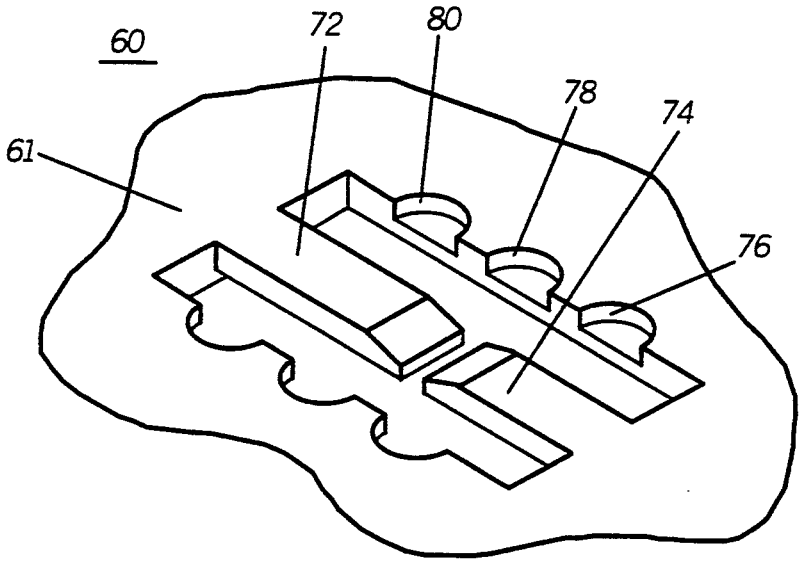
FIG. 4 is a perspective view of another slide switch in accordance with the present invention.
Figure 5:
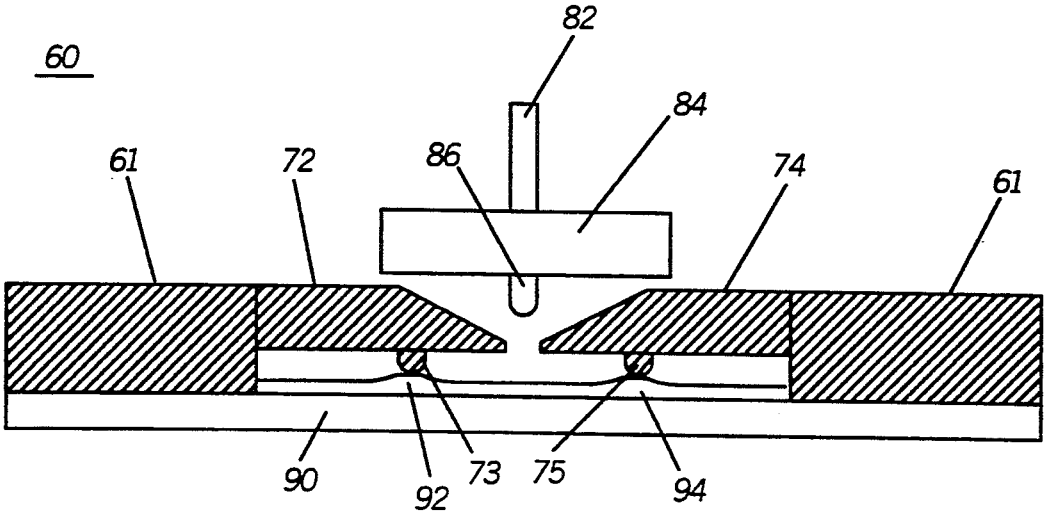
FIG. 5 is a cross-sectional view of the slide switch of FIG. 4.

Referring to FIG. 4, there is shown an alternative embodiment 60 of the slide switch 10 having opposing cantilever beams 72 and 74 integrally formed within a housing 61. The housing 61 similarly includes detent features 76, 78, and 80. The cantilever bar also comprises protruding members 73 and 75 (not shown in FIG. 4) shown in FIG. 5. Referring to FIG. 5, there is shown a cross sectional view of the slide switch 60 along with a slide actuator having a pedestal 82, a horizontal member 84 and a protruding member 86. Below the housing 61 lies the keypad having a substrate 90 and keys or popple-type switches 92 and 94. The slide actuator (as shown) resides centrally in a normal or off position. As the slide actuator is shifted to the right, up the ramp-like feature on the cantilever beam 74, the protruding member 86 depresses the cantilever beam 74 and its protruding member 75 towards the popple switch 94. Likewise, as the slide actuator is shifted to the left on the cantilever beam 72, the protruding member 86 depresses the cantilever beam 72 and its protruding member 73 towards the popple switch 92.

Figure 6:
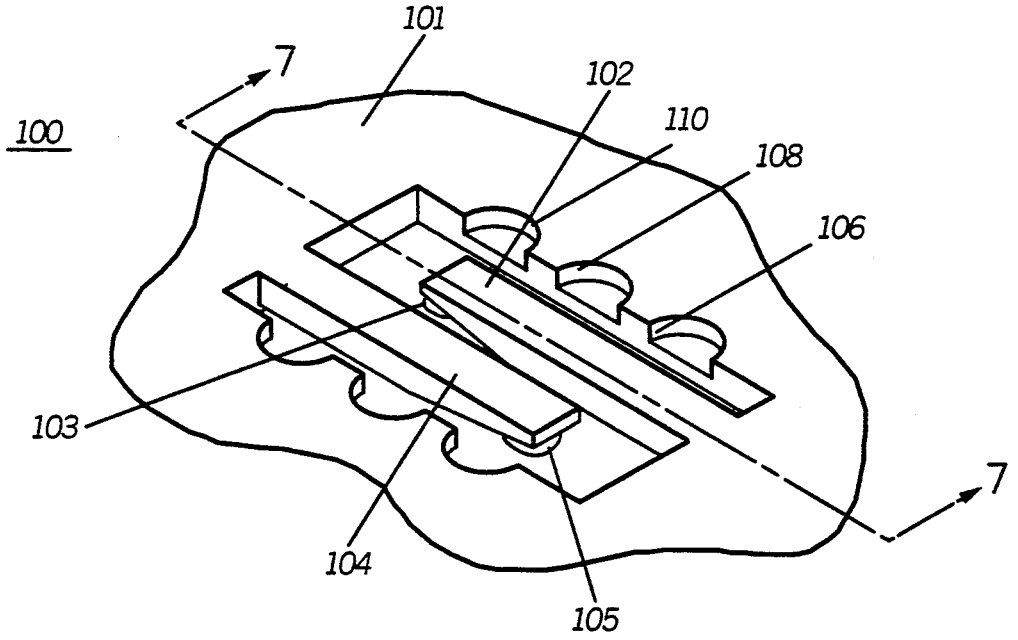
FIG. 6 is a perspective view of another slide switch in accordance with the present invention.
Figure 7:
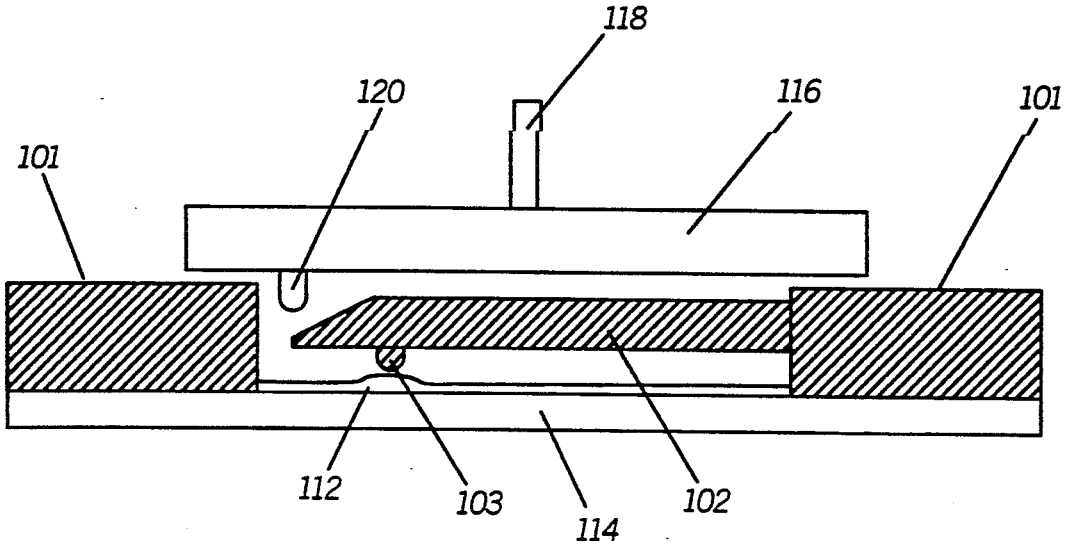
FIG. 7 is a cross-sectional view of the slide switch of FIG. 6 along line 7—7.

Referring to FIG. 6, there is shown an alternative embodiment 100 of the slide switch 10 having opposing adjacent cantilever beams 102 and 104 integrally formed within a housing 101. The housing 101 similarly includes detent features 106, 108, and 110. The cantilever beams 102 and 104 also comprises protruding members 103 and 105 respectively shown in FIGS. 6 and 7. Referring to FIG. 7, there is shown a cross sectional view of the slide switch 100 along line 7—7, along with a slide actuator having a pedestal 118, a horizontal member 116 and a protruding member 120. Below the housing 101 lies the keypad having a substrate 114 and a popple switch 112. The slide actuator (as shown) resides in either the extreme right or left in a normal or off position. As shown, as the slide actuator is shifted to the right, up the ramp-like feature on the cantilever beam 102, the protruding member 120 depresses the cantilever beam 102 and its protruding member 103 towards the popple switch 112.

Figure 8:
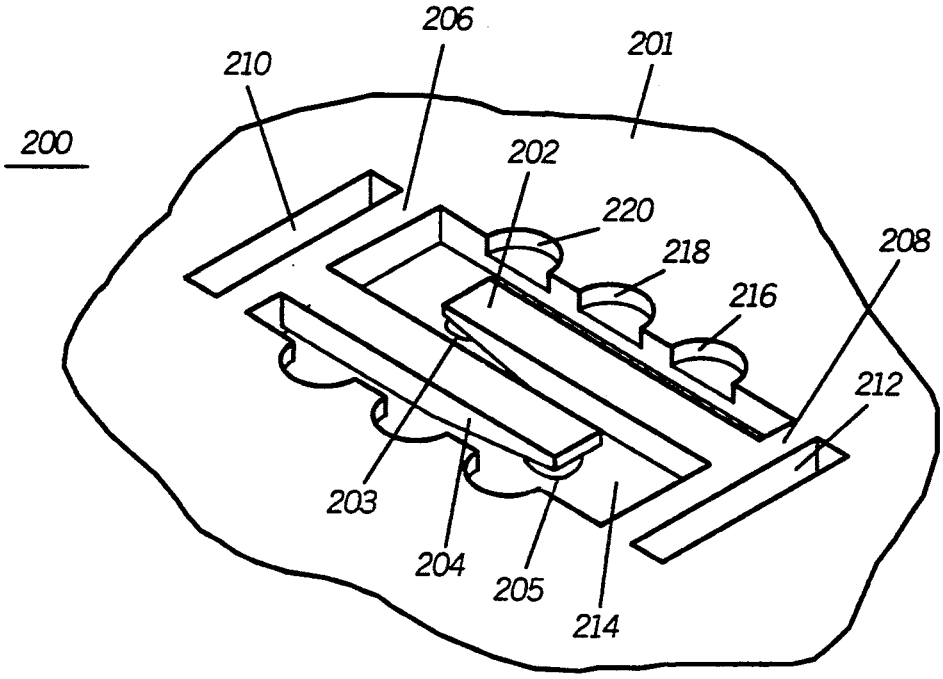
FIG. 8 is a perspective view of an alternative embodiment of FIG. 6.

Referring to FIG. 8, there is shown another alternative embodiment of the present invention similar to the embodiment of FIGS. 6 and 7. This slide switch 200 comprises a housing 201 having an opening 214 and cantilever beams 202 and 204. Additionally, torsion bars 206 and 208 are formed at opposing ends of the cantilever beams 202 and 204 to allow for further flexibility and resiliency. Torsion bars 206 and 208 are formed by providing apertures 210 and 212 at opposing ends of the cantilever beams. The integral slide switch 200 of FIG. 8 functions substantially the same as the integral slide switch 100 of FIG. 6 with the exception of the twisting or rotating motion of the torsion bars 206 and 208 as the slide actuator (not shown) shifts from left to right.

What is claimed is:

1. A slide switch, comprising:

a substrate;

an elastomeric keypad mounted on the substrate;

a housing with an aperture enclosing the substrate and keypad, a portion of said housing being located above said keypad and having at least one torsion bar within the aperture;

a cantilever beam integrally formed within said housing aperture and coupled perpendicularly to the torsion bar; and a horizontal slide actuator means constructed to slide over said cantilever beam for substantially vertically biasing said cantilever beam toward said keypad to selectively engage a key on the keypad.

2. The slide switch of claim 1, wherein said substrate and said elastomeric keypad comprises a membrane keypad.

3. The slide switch of claim 1, wherein said horizontal slide actuator means comprises an integral member having a handle protruding from an aperture in said housing and for selectively sliding said slide actuator means within the constraints of the aperture in said housing.

4. The slide switch of claim 1, wherein the slide switch is used for a communication device.

5. The slide switch of claim 1, wherein the slide switch further comprises detent features having substantially semicircular protrusions on the slide actuaror means and substantially semicircular indentations in the housing.

6. A slide switch, comprising:

a housing with an aperture having at least one cantilever beam integrally formed within the aperture;

a keypad mounted within said housing and arranged to be below said at least one cantilever beam;

a horizontal side actuator means mounted within the aperture of the housing and arranged to horizontally slide over said at least one cantilever beam for substantially biasing said cantilever beam toward said keypad to selectively engage a key on the keypad.

7. The slide switch of claim 6, wherein said housing comprises two opposing cantilever beams for selectively biasing either cantilever beams toward the keypad.

8. The slide switch of claim 6, wherein the slide switch is used for a communication device.

9. The slide switch of claim 6, wherein the slide switch further comprises detent features having substantially semicircular protrusions on the slide actuator means and substantially semicircular indentations in the housing.

10. A slide switch, comprising:

a substrate having conductive traces located beneath defining a plurality of keys of a keypad;

membrane connector means mounted above said conductive traces for selectively connecting a desired key of said keypad;

a housing with an aperture and having at least one cantilever beam integrally formed within the aperture for retaining said substrate and said membrane connector means;

a slide actuating means for selectively biasing said membrane connector means toward said conductive traces by moving said slide actuating means horizontally, wherein a portion of said slide actuating means protrudes from an aperture in said housing.

11. The slide switch of claim 10, wherein said substrate and said membrane connector means comprises a membrane keypad.

12. The slide switch of claim 10, wherein said slide actuating means has a protruding feature substantially conical in form for biasing said membrane connector means toward said conductive traces.

13. The slide switch of claim 10, wherein said slide actuating means comprises an integral member having a handle protruding from the aperture in said housing and for selectively sliding said slide actuating means within the constraints of the aperture in said housing.

14. The slide switch of claim 10, wherein the slide switch is used for a communication device.

15. The slide switch of claim 10, wherein the housing has indented detent features and the slide actuating means has matching protruding detent features for mating with the indented detent features.

16. The slide switch of claim 10, wherein the membrane connector means of said slide switch provides an evironmental seal for the substrate.

* * * * *